US005260713A

United States Patent [19]

Motson

[11] Patent Number: 5,260,713

[45] Date of Patent: Nov. 9, 1993

[54] MICROWAVE SIGNAL RECEIVING APPARATUS

[75] Inventor: Richard J. Motson, Hants, England

[73] Assignee: Motson & Company Limited, England

[21] Appl. No.: 684,948

[22] PCT Filed: Oct. 27, 1989

[86] PCT No.: PCT/GB89/01285

§ 371 Date: May 13, 1991

§ 102(e) Date: May 13, 1991

[87] PCT Pub. No.: WO90/06002

PCT Pub. Date: May 31, 1990

[30] Foreign Application Priority Data

Nov. 14, 1988 [GB] United Kingdom ..... 8826604
Dec. 12, 1988 [GB] United Kingdom ..... 8828958

[51] Int. Cl.[5] ..... H01Q 19/00; H01Q 15/24

[52] U.S. Cl. ..... 343/756; 343/840; 333/21 A

[58] Field of Search ..... 343/756, 786, 840, 787; 333/21 A

[56] References Cited

U.S. PATENT DOCUMENTS 2,863,144 12/1958 Herscovici et al. ..... 343/756
3,216,017 11/1965 Moore ..... 343/756
3,445,851 5/1969 Sheldon ..... 343/756
4,498,061 2/1985 Mörz et al. ..... 343/756

FOREIGN PATENT DOCUMENTS 0252269 1/1988 European Pat. Off. .

*Primary Examiner*—Donald T. Hajec
*Assistant Examiner*—Huanganh Le
*Attorney, Agent, or Firm*—Leydig, Voit & Mayer

[57] ABSTRACT

In order to isolate microwaves of a selected polarization from incident microwaves collected by means of a dish reflector (10), a ferrite polarizer (16) is positioned at the focal point of the reflector. A ferrite body (26) of the polarizer extends axially of a wave guide (18) with a convergent receiving end (28) positioned outside the wave guide at the focal point and a convergent transmitting end (30) positioned within the wave guide. The ferrite body is mounted in an end portion of the wave guide by means of a plastics dielectric bobbin (32). The bobbin encases all but the transmitting end of the ferrite body, which projects beyond the bobbin into the wave guide. A controlling coil (36) of the polarizer, which creates an axial magnetic field in relation to the ferrite body, is wound around the bobbin within the end portion of the wave guide.

7 Claims, 1 Drawing Sheet

MICROWAVE SIGNAL RECEIVING APPARATUS

This invention is concerned with a microwave signal receiving apparatus for receiving satellite television transmissions comprising a receiving element, focusing means for focusing incident plane-polarized microwaves at a focal point, a waveguide for guiding the focused microwaves to the receiving element, and a ferrite polarizer operable to effect controlled rotation of the microwaves in order to isolate those microwaves of a selected polarization which become duly rotated for onward transmission through the waveguide and reception by the receiving element.

Ordinarily a dish reflector has been utilised in such apparatus to focus the incident microwaves at the focal point, and a horn has been used to feed the collected microwaves into the wave guide. The receiving element may, for example, be a wave guide probe associated with a low noise block down converter.

In order to isolate microwaves of a selected polarization, the apparatus comprises a polarizer by means of which controlled rotation of the planes of polarization of collected microwaves can be effected. By means of such rotation, microwaves in any particular selected plane of polarization can be brought to be duly aligned for reception by the receiving element, and so isolated from microwaves in other planes of polarization.

Whilst different types of polarizer have been used in such circumstances, one known type which has been used with advantage is that usually known as a ferrite polarizer. This solid state device comprises a ferrite body, through which microwave energy can be passed, and around which an electrically conductive coil extends. By means of the coil an axial magnetic field can be created in relation to the ferrite body. In the presence of such a magnetic field, there occurs rotation of the plane of polarization of plane-polarized microwave energy passing through the body, such rotation being referred to as Faraday rotation, or being said to exhibit the Faraday effect. Variation of the strength of the magnetic field results in variation of the degree of rotation achieved, and accordingly the rotation effected during passage of the microwaves through the ferrite body can be controlled.

It is known to mount such a ferrite polarizer within the wave guide, for example as described in EP-A1-0237 988. The collected microwaves are fed into the wave guide by means of a horn and pass along the wave guide to the polarizer before onward transmission through the wave guide to the receiving element.

Apparatus according to the invention is characterised in that the polarizer is positioned at the focal point to receive microwaves from the focusing means and to transmit the isolated microwaves into the waveguide and so to the receiving element.

In a preferred construction, a ferrite body of the polarizer comprises a receiving end portion positioned at the focal point and a transmitting end portion positioned within the wave guide. Both the receiving and transmitting end portions of the body may comprise convergent tips.

Preferably, at least the receiving end portion of the ferrite body is encased by a housing of a dielectric material. This can be not only for protection of the body but may also give an improved performance. The dielectric material may be, for example, a plastics material such as polypropylene. Where the dielectric housing encases the receiving end portion of the body it may, like the body, be beneficial for it to be convergent in the direction extending away from the wave guide. Whilst the housing may encase most of the ferrite body, the body should preferably project (with its transmitting end portion) beyond the housing into the wave guide.

The dielectric housing may comprise a mounting portion forming a plug which is located in an end portion of the wave guide. The controlling coil of the polarizer may be wound about the housing within the end portion of the wave guide.

There now follows a detailed description, to be read with reference to the accompanying drawings, of signal receiving equipment which illustrates the invention by way of example.

Figure 1:
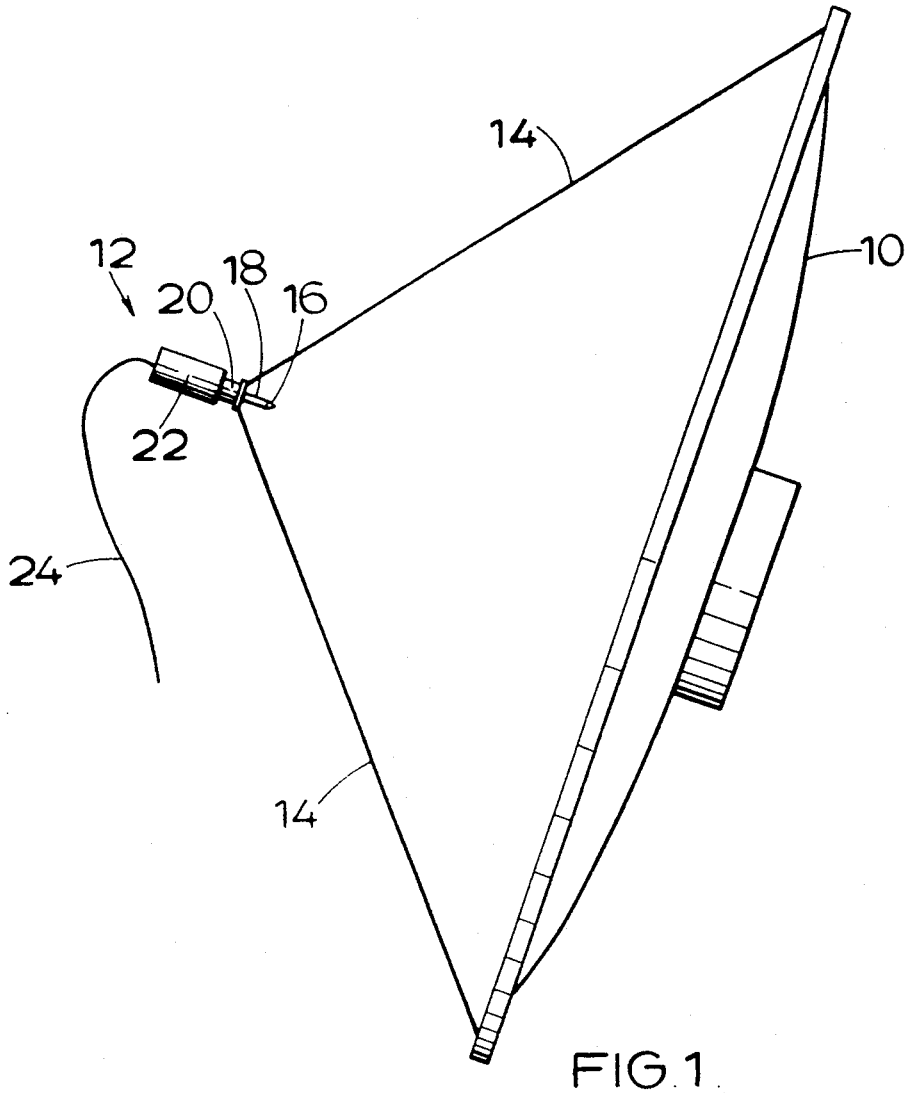
FIG. 1 is a view of the equipment in perspective.

Equipment for receiving microwave television signals from satellites comprises a dish reflector 10. A signal handling unit 12 is secured by means of stays 14 at a distance from the reflector and comprises a ferrite polarizer 16, a tubular wave guide 18, control electronics 20 and a low noise block down converter 22. A coaxial cable 24 extends between the signal handling unit 12 and a conventional receiver which processes the signal received.

Figure 2:
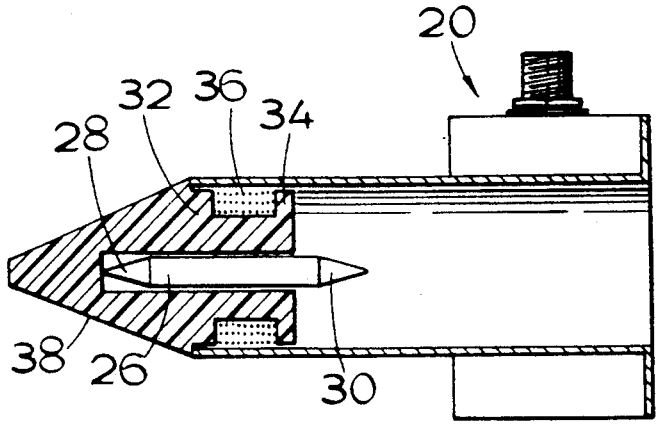
FIG. 2 is a view in cross-section of a ferrite polarizer positioned within the entry to a wave guide.

The arrangement of the polarizer 16 and wave guide 18 is shown in detail in FIG. 2. The polarizer comprises an elongate ferrite body in the form of a rod 26 of generally square cross-section. A receiving end portion 28 and a transmitting end portion 30 comprise convergent tips at opposite ends of the body, each with an angle of taper of about 7°. The ferrite rod has a cross-section of approximately 15.21 sq mm and is approximately 4 cm long. It has a coefficient of resistivity in the order of $10^{12}$ ohm cm and a permittivity in the range of 5 to 20. For example, it may be of yttrium aluminium iron garnet.

The ferrite rod 26 is mounted coaxially with the wave guide 18 by means of a plastics bobbin 32; the bobbin forms a housing of a dielectric material such as polypropylene. The bobbin comprises a portion 34 forming a plug which is located in an end portion of the wave guide 18 to mount the ferrite rod 26 in the wave guide. An electrical control coil 36 is wound around the portion 34, within the end portion of the wave guide, the windings being received in an external annular recess of the bobbin. Leads (not shown) from the coil extend along the wave guide to the control electronics 20.

The ferrite rod 26 is largely encased by the plastics bobbin 32 except that at its transmitting end (including its transmitting end portion 30) the rod projects beyond the plug-forming portion 34 of the bobbin into the wave guide.

At its opposite end, the ferrite rod 26 projects beyond the end of the wave guide, so that the receiving end portion 28 is positioned outside the wave guide. A nose portion 38 of the bobbin 32, which encases the receiving end portion 28 of the ferrite body 26, is convergent in the direction extending away from the wave guide 18. The housing formed by the plastics bobbin 32 so protects the ferrite body where it projects from the wave guide, but furthermore it can give an improved performance in operation of the polarizer.

The signal handling unit 12 is so secured in relation to the dish reflector 10 that the nose portion 38 of the bobbin and the receiving end portion 28 of the ferrite body 26 are together positioned at the focal point of the dish reflector. Incident plane-polarized microwaves collected at the focal point of the dish reflector 10 so become directed along the length of the ferrite body and into the wave guide 18. The microwaves pass along the wave guide to a receiving element (not shown) associated with the low noise block down converter 22.

In known manner, the polarizer can be operated to isolate plane-polarized microwaves of a selected polarization. The coil 36, when energised, creates an axial magnetic field in relation to the ferrite body 26, and owing to such a magnetic field there occurs a rotation of the plane of polarization of microwaves passing along the body; such rotation occurs in accordance with the well known effect of Faraday rotation. The degree of rotation achieved can be controlled by controlling the electric current passed through the coil 36, and so the strength of the magnetic field. The polarizer is therefore operable to effect controlled rotation of the microwaves passing through, and so microwaves in any particular selected plane of polarization can be brought into suitable alignment for reception by the receiving element of the converter 22.

I claim:

1. A microwave signal receiving apparatus for receiving satellite television transmissions comprising a receiving element, means for focusing incident plane-polarized microwaves at a focal point, a waveguide for guiding the focused microwaves to the receiving element, a polarizer operable to effect controlled rotation of the microwaves in order to isolate those microwaves of a selected polarization that are duly rotated for onward transmission through the waveguide and reception by the receiving element, the polarizer including a ferrite body positioned to receive microwaves from the focusing means and to transmit the isolated microwaves into the waveguide and on to the receiving element, the ferrite body of the polarizer comprising a receiving end portion positioned at the focal point and encased by a housing of a dielectric material, and further comprising a transmitting end portion projecting beyond the dielectric housing into the waveguide.

2. A device for use in microwave signal receiving apparatus having a receiving element, the device comprising a waveguide and a ferrite polarizer, and ferrite polarizer being within the waveguide and being operable to effect controlled rotations of plane-polarized microwaves for onward transmission of isolated microwaves through the waveguide to the receiving element, and said polarizer having a ferrite body projecting beyond the waveguide so that a receiving end portion of the body is positioned outside the waveguide.

3. A device according to claim 2 in which at least the receiving end portion of the ferrite body is enclosed by a housing (32) of a dielectric material.

4. A device according to claim 3 in which a portion of the dielectric housing which encases the receiving end portion of the ferrite body (26) is convergent in the direction extending away from the waveguide.

5. A device according to claim 3 in which a transmitting end portion of the ferrite body projects beyond the dielectric housing into the waveguide.

6. A device according to claim 3 in which the dielectric housing forms a plug located in an end portion of the waveguide.

7. A device according to claim 3 in which a controlling coil of the polarizer is wound about the housing within an end portion of the waveguide for creation of an axial magnetic field in relation to the ferrite body.

* * * * *